US009930922B2

(12) United States Patent
Follet

(10) Patent No.: US 9,930,922 B2
(45) **Date of Patent: *Apr. 3, 2018**

(54) ARTICLE OF FOOTWEAR INCORPORATING BRAIDED TENSILE STRANDS

(71) Applicant: NIKE, Inc., Beaverton, OR (US)

(72) Inventor: Lysandre Follet, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/385,467

(22) Filed: Dec. 20, 2016

(65) Prior Publication Data

US 2017/0099905 A1 Apr. 13, 2017

Related U.S. Application Data

(63) Continuation of application No. 14/753,779, filed on Jun. 29, 2015, now Pat. No. 9,554,614, which is a continuation of application No. 13/741,449, filed on Jan. 15, 2013, now Pat. No. 9,095,186.

(51) Int. Cl.

| | |
|---|---|
| ***A43B 1/04*** | (2006.01) |
| ***A43B 23/02*** | (2006.01) |
| ***D04C 1/12*** | (2006.01) |
| ***A43B 13/18*** | (2006.01) |
| ***A43C 1/04*** | (2006.01) |

(52) U.S. Cl.

CPC ..... *A43B 1/04* (2013.01); *A43B 13/181* (2013.01); *A43B 23/0205* (2013.01); *A43B 23/0245* (2013.01); *A43B 23/0265* (2013.01); *A43C 1/04* (2013.01); *D04C 1/12* (2013.01); *D10B 2501/043* (2013.01)

(58) Field of Classification Search

CPC ..... A43B 1/04; A43B 23/00; A43B 23/0205
USPC ..... 36/45, 50.1
See application file for complete search history.

(56) References Cited

U.S. PATENT DOCUMENTS

| | | | |
|---|---|---|---|
| 1,997,771 | A | 4/1935 | McGowan |
| 2,412,808 | A | 12/1946 | Goldstein |
| 3,698,107 | A | 10/1972 | Tatsuo |
| 3,934,346 | A | 1/1976 | Sasaki et al. |
| 4,027,406 | A | 6/1977 | Salvatore |
| 4,366,631 | A | 1/1983 | Larsen et al. |
| 5,979,080 | A | 11/1999 | Borsoi |
| 6,052,921 | A | 4/2000 | Oreck |
| 6,119,371 | A | 9/2000 | Goodwin et al. |

(Continued)

FOREIGN PATENT DOCUMENTS

| | | |
|---|---|---|
| CN | 201356120 | 12/2009 |
| EP | 0372370 | 6/1990 |

(Continued)

OTHER PUBLICATIONS

Examination Report, dated Feb. 15, 2017, for corresponding Australian Patent Application No. 2016219621, 3 pages.

(Continued)

*Primary Examiner* — Marie Bays
(74) *Attorney, Agent, or Firm* — Klarquist Sparkman, LLP

(57) ABSTRACT

A branched braid member has a central braid portion and one or more tensile strands or small braids at either end of the central braid portion. The branched braid member may be incorporated into a shoe upper.

19 Claims, 15 Drawing Sheets

(56) References Cited

U.S. PATENT DOCUMENTS

| | | | | |
|---|---|---|---|---|
| 6,513,210 | B1 | 2/2003 | Gonzalez | |
| 7,076,891 | B2 | 7/2006 | Goodwin | |
| 7,210,251 | B1 | 5/2007 | Rolle | |
| 7,444,768 | B2 | 11/2008 | Friton | |
| 8,132,340 | B2 | 3/2012 | Meschter | |
| 9,095,186 | B2 | 8/2015 | Follet | |
| 9,554,614 | B2 * | 1/2017 | Follet | A43B 23/0245 |
| 2008/0148600 | A1 | 6/2008 | Aveni et al. | |
| 2009/0144953 | A1 | 6/2009 | Tsai | |
| 2012/0023778 | A1 | 2/2012 | Dojan et al. | |
| 2012/0198727 | A1 | 8/2012 | Long | |
| 2012/0233882 | A1 | 9/2012 | Huffa et al. | |
| 2014/0202032 | A1 | 7/2014 | Alas | |

FOREIGN PATENT DOCUMENTS

| | | |
|---|---|---|
| FR | 2105444 | 4/1972 |
| FR | 2913238 | 9/2008 |
| GB | 473400 | 10/1937 |
| IN | 2820/CHENP/2015 | 7/2016 |
| JP | 57-99404 | 12/1955 |
| JP | 46-2758 | 1/1971 |
| JP | 2000198159 | 7/2000 |
| JP | 2005290628 | 10/2005 |
| TW | 361919 | 8/2009 |
| WO | WO 1995/22917 | 8/1995 |
| WO | WO 2011/011176 | 1/2011 |

OTHER PUBLICATIONS

International Preliminary Report on Patentability, dated Jul. 30, 2015, for corresponding International Patent Application No. PCT/US2014/011393, 8 pages.

International Search Report and Written Opinion, dated Jun. 4, 2014, for corresponding International Patent Application No. PCT/US2014/011393, 5 pages.

Notice of Allowance, dated Jun. 1, 2016, for corresponding South African Patent Application No. 2015/03255.

Notice of Allowance, dated Jun. 28, 2016, for corresponding Australian Patent Application No. 2014207747.

Office Action, dated Apr. 7, 2016, for corresponding Canadian Patent Application No. 2890390.

Office Action, dated Feb. 6, 2016, for corresponding Chinese Patent Application No. 201480004315.1, with English translation.

Response to Office Action, filed Jun. 21, 2016, for corresponding Chinese Patent Application No. 201480004315.1, with English translation.

Voluntary Amendment, filed Jan. 4, 2016, for corresponding Chinese Patent Application No. 201480004315.1, with English translation.

Office Action with English-language translation, dated Feb. 13, 2017, for corresponding Japanese Patent Application No. 2015-552875, 14 pages.

* cited by examiner

ARTICLE OF FOOTWEAR INCORPORATING BRAIDED TENSILE STRANDS

CROSS-REFERENCE TO RELATED APPLICATIONS

This application is a continuation of U.S. patent application Ser. No. 14/753,779, filed Jun. 29, 2015, entitled "Article of Footwear Incorporating Braided Tensile Strands," which is a continuation of U.S. patent application Ser. No. 13/741,449, filed Jan. 15, 2013, now issued U.S. Pat. No. 9,095,186, issued Aug. 4, 2015, entitled "Article of Footwear Incorporating Braided Tensile Strands;" each of these applications is specifically incorporated by reference herein in its entirety.

RELATED APPLICATIONS

The subject matter of this application is related to the following commonly owned co-pending applications: Beye et al., U.S. Patent Application Publication Number 2014/0196314, published on Jul. 17, 2014 and titled "Spacer Textile Material with Tensile Strands Having Multiple Entry and Exit Points" (previously U.S. patent application Ser. No. 13/741,428 filed Jan. 15, 2013); Beye et al., U.S. Patent Application Publication Number 2014/0196310, published Jul. 17, 2014, and titled "Spacer Textile Material with Tensile Strands in Non-Linear Arrangements" (previously U.S. patent application Ser. No. 13/741,433 filed Jan. 15, 2013); Beye et al., U.S. Patent Application Publication Number 2014/0196315, published Jul. 17, 2014, and titled "Spacer Textile Material with Strands that Intersect" (previously U.S. patent application Ser. No. 13/741,435); and Follett et al., U.S. Patent Application Publication Number 2014/0196311, published Jul. 17, 2014, and titled "Spacer Textile Material with Channels Having Multiple Strands," (previously U.S. patent application Ser. No. 13/741,440 filed Jan. 15, 2013), which are all incorporated by reference herein in their entireties.

BACKGROUND

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter.

The various material elements forming the upper impart specific properties to different areas of the upper. For example, textile elements may provide breathability and may absorb moisture from the foot, foam layers may compress to impart comfort, and leather may impart durability and wear-resistance. As the number of material elements increases, the overall mass of the footwear may increase proportionally. The time and expense associated with transporting, stocking, cutting, and joining the material elements may also increase. Additionally, waste material from cutting and stitching processes may accumulate to a greater degree as the number of material elements incorporated into an upper increases. Moreover, products with a greater number of material elements may be more difficult to recycle than products formed from fewer material elements. By decreasing the number of material elements, therefore, the mass of the footwear and waste may be decreased, while increasing manufacturing efficiency and recyclability.

The sole structure is secured to a lower portion of the upper so as to be positioned between the foot and the ground. In athletic footwear, for example, the sole structure includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximal a lower surface of the foot to enhance footwear comfort.

SUMMARY

In one aspect, an article of footwear includes an upper and a sole structure as well as a group of tensile strands forming a branched braid member. The branched braid member further includes a central braid portion with a first end and a second end, where at least two tensile strands extend from the first end of the central braid portion and where the branched braid member is incorporated into the upper.

In another aspect, an article of footwear includes an upper and a sole structure and a group of tensile strands forming a branched braid member. The branched braid member further includes a first braid portion with a first end and a second end. A second braid portion extends from the first end, where the second braid portion is substantially smaller than the first braid portion. At least two tensile strands extend from the second braid portion. The branched braid member is incorporated into the upper.

In another aspect, an article of footwear includes a group of tensile strands forming a branched braid member, where the branched braid member further includes a central braid portion with a first end and a second end. A first tensile strand and a second tensile strand extend from the first end of the central braid portion. A portion of the first tensile strand is disposed in a channel associated with the upper.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
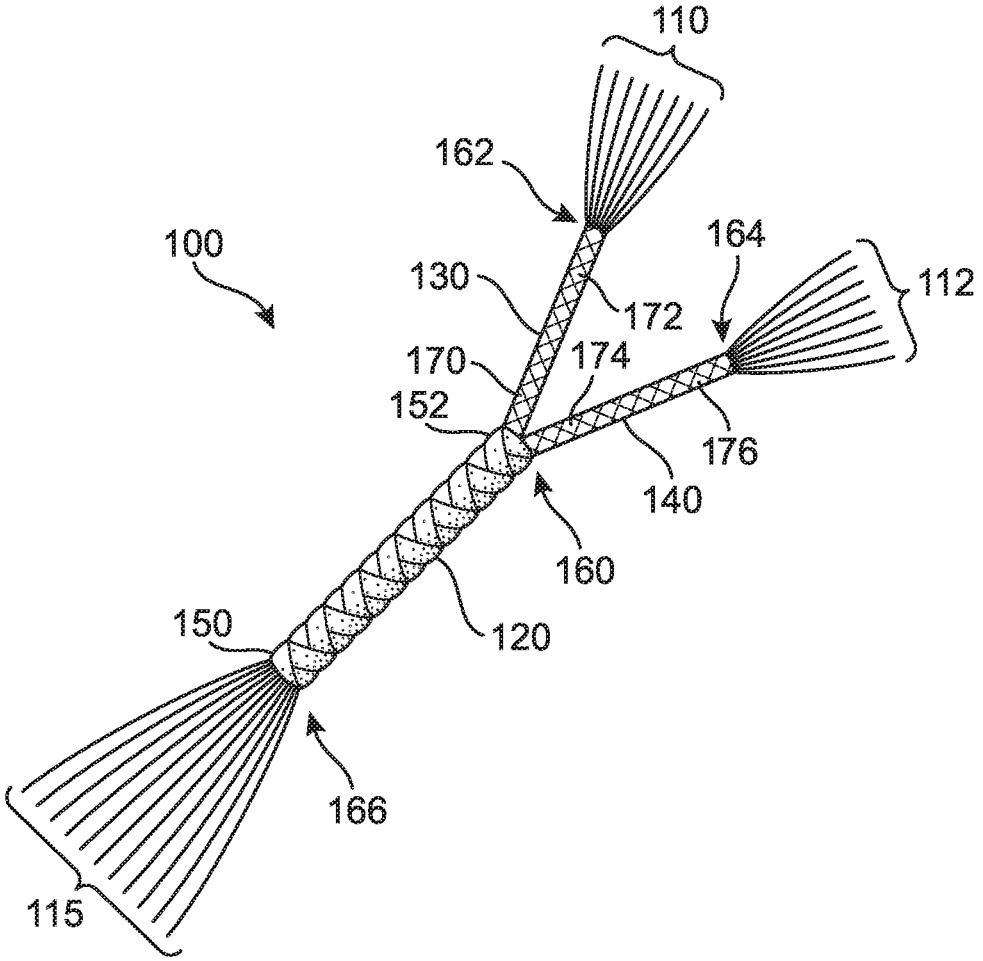
FIG. 1 is a schematic view of an embodiment of a branched braid member that is woven from thread on a first end and which branches into multiple tensile strands on a second end, where a braid portion is substantially round.

FIG. 1 is a schematic view of an embodiment of a branched braid member 100. Branched braid member 100 may comprise a plurality of tensile strands which may be braided into one or more braided portions. As described in further detail below, each branched braid member may comprise various different structures formed by twisting, braiding or otherwise joining various different threads, wires, or any other substantially elongate materials. In some embodiments, for example, branched braid member 100 may be comprised of a plurality of threads, which may be formed into one or more tensile strands. These tensile strands may then be twisted, braided, or otherwise joined together, to form one or more braid portions.

In the embodiment shown in FIG. 1, branched braid member 100 comprises first tensile strand 130 and second tensile strand 140. In some embodiments, first tensile strand 130 and second tensile strand 140 may be braided together to form braid portion 120. Furthermore, each of first tensile strand 130 and second tensile strand 140 may be formed from one or more threads. For example, first tensile strand 130 may be formed by combining first group of threads 110. Likewise, second tensile strand 140 may be formed by combining second group of threads 112. For purposes of reference, first group of threads 110 and second group of threads 112 may be referred to collectively as plurality of threads 115.

The branched configuration of branched braid member 100 can be understood as a progressive branching of the material constituents from one structure to a sub-structure of branched braid member 100. For example, as previously discussed, branched braid member 100 includes braid portion 120. Braid portion 120 comprises a portion of branched braid member 100 where first tensile strand 130 and second tensile strand 140 have been braided together. In the current embodiment, braid portion 120 may include a first end 150 and a second end 152. A first branching 160 of branched braid member 100 occurs at second end 152. In particular, at first branching 160, first tensile strand 130 and second tensile strand 140 extend separately away from braid portion 120. Equivalently, at first branching portion 160, first tensile strand 130 and second tensile strand 140 join to begin forming braid portion 120.

In some embodiments, branched braid member 100 may include further branching points. In some embodiments, each of first tensile strand 130 and second tensile strand 140 may further branch into the constituent threads that comprise each tensile strand. In one embodiment, first tensile strand 130 includes a first end 170 and a second end 172. First end 170 may be associated with second end 152 of braid portion 120. Second end 172 may be associated with second branching portion 162. In particular, in some embodiments, threads from first group of threads 110 may extend from second branching portion 162 as individual threads. Equivalently, at second branching portion 162, first group of threads 110 join to begin forming first tensile strand 130. In a similar manner, second tensile strand 140 may include a first end 174 and a second end 176. First end 174 may be associated with second end 152 of braid portion 120, while second end 176 may be associated with third branching portion 164. In particular, in some embodiments, individual threads from second group of threads 112 may extend from third branching portion 164. Equivalently, at third branching portion 164, second group of threads 112 join to begin forming second tensile strand 140.

In some embodiments, a braid portion may branch directly into individual threads, rather than first branching into tensile strands which further branch into threads. In some embodiments, first end 150 of braid portion 120 may include a fourth branching portion 166. In one embodiment, fourth branching portion 166 is a portion where the plurality of threads 115 (which are made up of first group of threads 110 and second group of threads 112) separate into individual threads.

In this exemplary embodiment, braid portion 120 is formed by braiding together first tensile strand 130 and second tensile strand 140, as discussed above. However, it will be understood that in other embodiments braid portion 120 may be braided directly from individual threads. In particular, it is possible in some embodiments to arrange individual threads into various sub-structures that can be braided together but that do not directly correspond to either of first tensile strand 130 or second tensile strand 140.

The tensile strands of the disclosure may be formed from any suitable material. In some embodiments, the tensile strands may be formed from any generally one-dimensional material. As utilized with respect to the present disclosure, the term "one-dimensional material", or variants thereof, is intended to encompass generally elongate materials exhibiting a length that is substantially greater than a width and a thickness. In some embodiments, each tensile strand may further comprise one or more threads or similar generally one-dimensional materials. Accordingly, suitable materials for a tensile strand may include various filaments, fibers, yarns, threads, cables, cords, or ropes. Suitable material for a tensile strand may be formed from or include rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, steel, and various combination of these kinds of materials.

In some embodiments, tensile strands may be formed from filaments and/or fibers. Filaments have an indefinite length and may be utilized individually as a tensile strand. Fibers have a relatively short length and generally go through spinning or twisting processes to produce a strand of suitable length. An individual filament utilized in a tensile strand may be formed from a single material (i.e., a monocomponent filament) or from multiple materials (i.e., a bicomponent filament). Similarly, different filaments may be formed from different materials. As an example, yarns utilized as a tensile strand may include filaments that may be formed from a common material, or may include filaments that may be formed from two or more different materials. Similar concepts also apply to threads, cables, or ropes.

The branched braid member of the disclosure may include two or more tensile strands. In some embodiments, when the spacer textile material includes multiple tensile strands, the tensile strands may be made from the same material. In some embodiments, the tensile strands may be made from different materials. When the tensile strands are made from different materials, the tensile strands may include different characteristics. For example, a first tensile strand may stretch when a force is applied. In some embodiments, a second tensile strand may stretch less than first tensile strand. In other embodiments, a second tensile strand may stretch more than the first tensile strand.

In some embodiments, the thickness of tensile strands may also vary significantly. In some embodiments, for example, the thickness of tensile strands could approximately range from less than 0.03 millimeters to more than 5 millimeters. Although one-dimensional materials will often have a cross-section where width and thickness are substantially equal (e.g., a round or square cross-section), some one-dimensional materials may have a width that is greater than a thickness (e.g., a rectangular, oval, or otherwise elongate cross-section). Despite the greater width, a material may be considered one-dimensional if a length of the material is substantially greater than a width and a thickness of the material.

In some embodiments having multiple tensile strands, the thickness of each strand may be the same. In some embodiments, the thickness of each tensile strand may be different. The relative thickness of two or more tensile strands may be selected according to various factors including desired strength, elasticity, manufacturing considerations as well as possible other factors.

Examples of suitable tensile strands are disclosed in any of the following: Dojan et al., U.S. Pat. No. 8,925,129, issued on Jan. 6, 2015, and entitled "Methods of Manufacturing Articles of Footwear With Tensile Strand Elements"; Dojan et al., U.S. Pat. No. 8,819,963, issued on Sep. 2, 2014, and entitled "Articles of Footwear With Tensile Strand Elements"; and Dojan et al., U.S. Pat. No. 8,973,288, issued Mar. 10, 2015, and entitled "Footwear Incorporating Angled Tensile Strand Elements," the entirety of each being hereby incorporated by reference.

Similarly, the individual threads (or other generally one-dimensional elements) that make up a tensile strand may be formed from any of the materials discussed above for making tensile strands. Additionally, as the properties of each tensile strand may be varied to achieve composite structures having varying material characteristics, the properties of each thread comprising a single tensile strand could likewise be varied. In particular, the geometry, size, material composition as well as any other characteristics of each thread can be varied to form tensile strands having composite material characteristics.

In different embodiments, the geometry of one or more braid portions could vary. In some embodiments, a braid portion may have a substantially round cross-sectional shape. In other embodiments, a braid portion could have a substantially flat shape. In other words, in some embodiments, the width and length of a braid portion could be substantially greater than the thickness of the braid portion. Moreover, in still other embodiments the geometry, including the cross-sectional geometry, of a braid portion could vary in any other manner.

Figure 2:
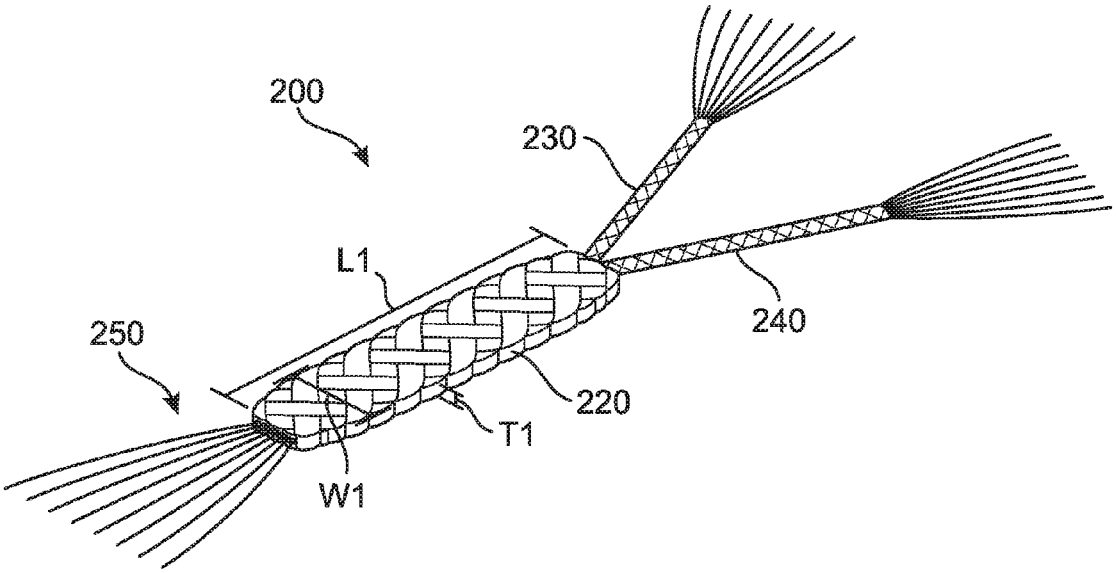
FIG. 2 is a schematic view of an embodiment of a branched braid member that is woven from thread on a first end and which branches into multiple tensile strands on a second end, where a braid portion is substantially flat.

An exemplary configuration of a branched braid member with a substantially flattened braid portion is shown in FIG. 2. Referring to FIG. 2, branched braid member 200 may be similar to branched braid member 100 of the embodiment shown in FIG. 1 and discussed above. In particular, branched braid member 200 is configured with a braid portion 220 that branches into a first tensile strand 230 and a second tensile strand 240. Furthermore, ends of braid portion 220, first tensile strand 230 and second tensile strand 240 each further branch into separate threads, collectively referred to here as plurality of threads 250.

Whereas FIG. 1 is seen to illustrate an approximately rounded braid portion 120, braid portion 220 is seen to be substantially flattened. In particular, the thickness T1 of braid portion 220 is substantially less than the width W1 and the length L1 of braid portion 220. This flattened geometry may allow braid portion 220 to be better fastened against, or otherwise associated with, a portion of an article of footwear and/or apparel.

While the figures of this disclosure depict the braid portions of each branched braid member as comprising structures that are substantially flat or round, the various structures of a branched braid member may be any suitable shape. Likewise, the structures of the branched braid member may be any suitable size. The size and shape of the various structures or portions may depend on the use of the branched braid member, the materials used to form the branched braid member, the desired support provided by the branched braid member, and the manner in which the branched braid member is manufactured, among other factors. Some suitable shapes for structures or portions of a branched braid member, include, but are not limited to: round shapes, flat shapes, square shapes, rectangular shapes, triangular shapes, oval shapes, regular shapes, irregular shapes as well as any other kinds of shapes.

Figure 3:
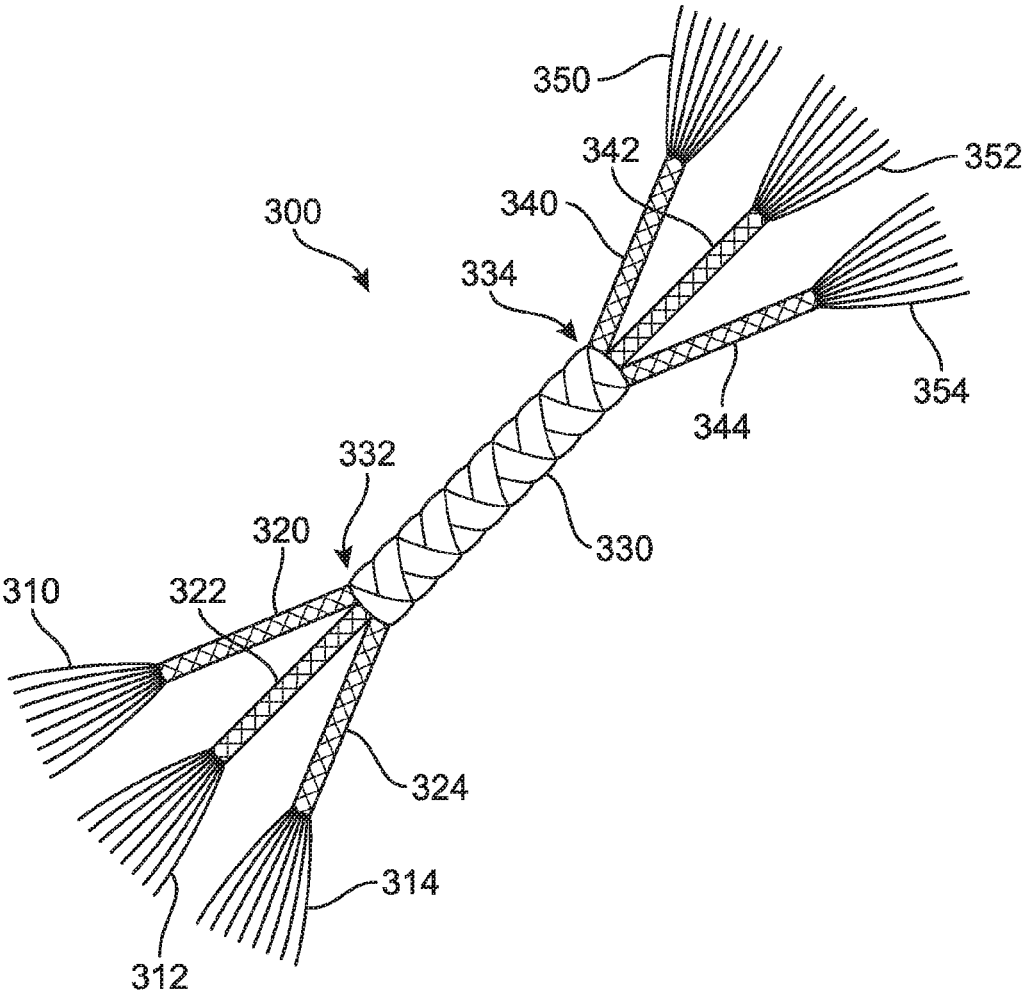
FIG. 3 is a schematic view of an embodiment of a braid portion that branches into multiple tensile strands on both ends.

FIG. 3 illustrates still another embodiment of a branched braid member 300 that separates into individual tensile strands on opposing ends of a braid portion. Referring to FIG. 3, branched braid member 300 includes a braid portion 330 having a first end 332 and a second end 334. In some embodiments, multiple tensile strands may branch from both ends of braid portion 330. More specifically, first tensile strand 320, second tensile strand 322 and third tensile strand 324 may separate and extend from first end 332 of braid portion 330. Similarly, fourth tensile strand 340, fifth tensile strand 342 and sixth tensile strand 344 may separate and extend from second end 334 of braid portion 330.

In some embodiments, first tensile strand 320, second tensile strand 322 and third tensile strand 324 may be substantially different tensile strands from fourth tensile strand 340, fifth tensile strand 342 and sixth tensile strand 344. However, in other embodiments, tensile strands on either end of braid portion 330 may be portions of the same tensile strand. For example, in one embodiment, first tensile strand 320 and fourth tensile strand 340 may comprise different portions of the same single tensile strand. Likewise, second tensile strand 322 and fifth tensile strand 342 may comprise different portions of the same tensile strand. Further, third tensile strand 324 and sixth tensile strand 344 may comprise different portions of the same tensile strand. In such an embodiment, three tensile strands are joined at first end 332 and are braided together throughout braid portion 330. These same three tensile strands then separate into three individual tensile strands again at second end 334 of braid portion 330.

In some embodiments, each tensile strand may separate into individual threads. More specifically, first tensile strand 320 may separate into first group of threads 310. Similarly, second tensile strand 322 may separate into second group of threads 312, third tensile strand 324 may separate into third group of threads 314, fourth tensile strand 340 may separate into fourth group of threads 350, fifth tensile strand 342 may separate into fifth group of threads 352 and sixth tensile strand 344 may separate into sixth group of threads 354. In embodiments where each of first tensile strand 320, second tensile strand 322, third tensile strand 324, fourth tensile strand 340, fifth tensile strand 342 and sixth tensile strand 344 are distinct tensile strands, the corresponding groups of threads may likewise be distinct threads. However, in embodiments where, for example, first tensile strand 320 and fourth tensile strand 340 are different portions of a single tensile strand, first group of threads 310 and fourth group of threads 350 may likewise comprise different portions of the same collection of threads.

The figures may show the ends of each tensile strand branching further into threads. However, the ends of each tensile strand may be finished in any suitable manner. For example, the ends of the tensile strand may be knotted, tied off, or fused so that the ends do not fray or diminish the integrity of the tensile strand. In other embodiments, the ends of each tensile strand may be separated further into individual threads. The individual threads may then be incorporated into an article of footwear and/or apparel, as discussed in further detail below.

The branched braids described in this disclosure may be symmetrical or asymmetrical. The embodiment depicted in FIG. 3 may be symmetrical. In particular, this embodiment includes three tensile strands extending on either side of braid portion 330. In other embodiments, a branched braid may not have the same number of tensile strands branching from each end of the braid portion. For instance, a first end of a braid portion may include two tensile strands while the second end may include four tensile strands. In such an embodiment, the branched braid member may be considered to have an asymmetric configuration. Moreover, each end of the braid portion may contain any number of branches (i.e., tensile strands, small braid portions, or threads).

In some embodiments, the threads of a branched braid member may be made of the same material. In other embodiments, the threads of a branched braid member may be made of different materials. Further, in some embodiments, each tensile strand of the branched braid may be made of the same material. In still other embodiments, each tensile strand of the branched braid may be made of different materials. The materials chosen for the branched braid member may be selected based the intended use and/or position on the article of footwear.

In some embodiments, one or more of the tensile strands may be formed from a material that is stronger and more resistant to stretch when a force is applied. In other embodiments, one or more of the tensile strands may be formed from a material that stretches more easily when a force is applied. In still further embodiments, the materials used to form the branched braid member may be a combination of materials. The strength and/or stretch of each material used to form the various portions of a branched braid may depend on the amount of stretch or strength desired, and the position on the article of footwear, among other factors.

As a possible example, in FIG. 3, first tensile strand 320 may be made of a material that provides moderate stretch when a force is applied while second tensile strand 322 and third tensile strand 324 may be made of a material that stretches less than the material of first tensile strand 320 when a force is applied.

Braid portion 330 may have a combination of the materials of first tensile strand 320, second tensile strand 322, third tensile strand 324, fourth tensile strand 340, fifth tensile strand 342 and sixth tensile strand 344. Therefore, the stretch of braid portion 330 may be an aggregate of the stretch characteristics of the different materials of the different tensile strands. In other words, braid portion 330 may stretch less than first tensile strand 320. However, braid portion 330 may stretch more than second tensile strand 322 and third tensile strand 324. The stretch of braid portion 330 may therefore be an aggregate of the stretch of the tensile strands or threads that form braid portion 330.

FIGS. 4 through 7 illustrate a variety of different configurations for a branched braid member. The following configurations are only intended to be exemplary and it will be understood that still other configurations are possible.

Figure 4:
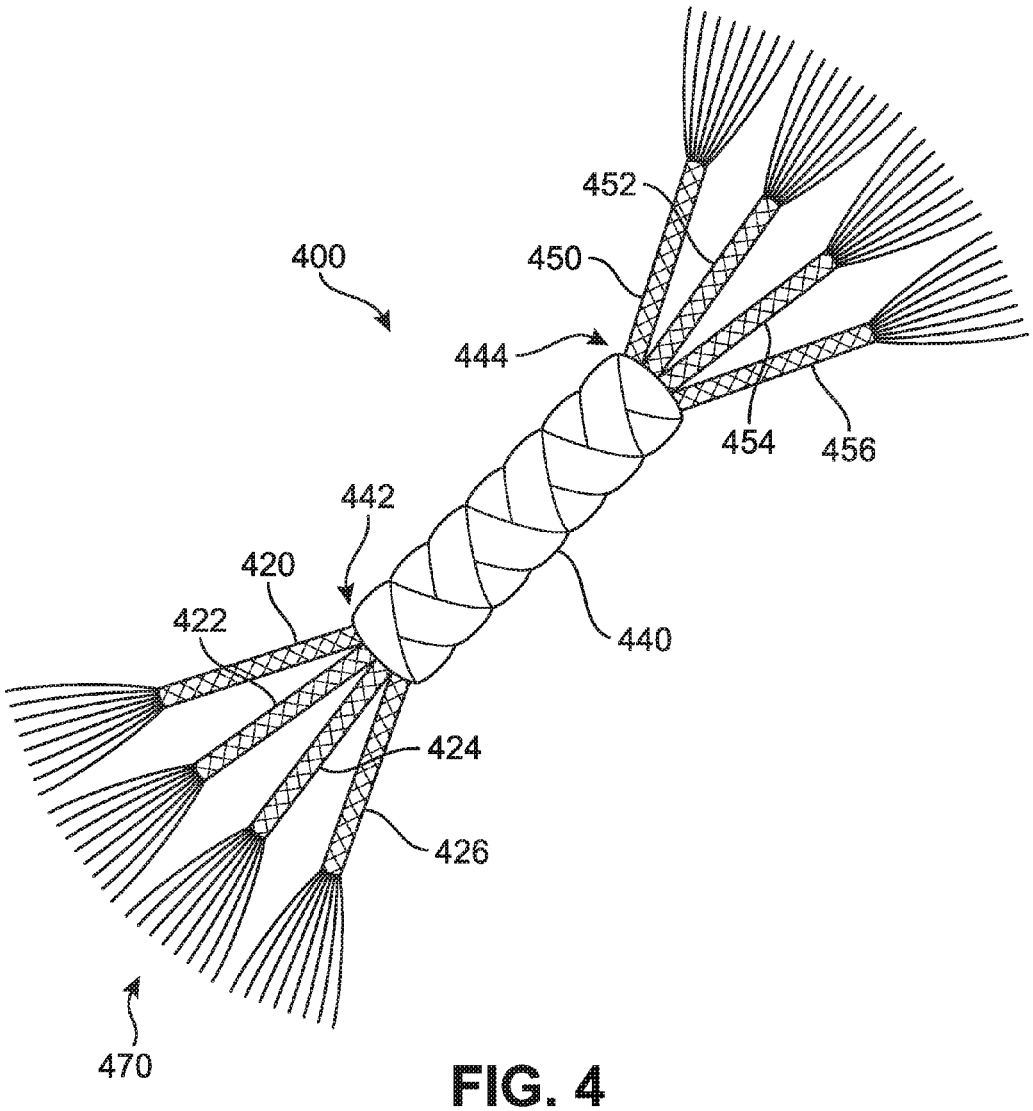
FIG. 4 is a schematic view of an embodiment of a braid portion that branches into multiple tensile strands on both ends.

FIG. 4 illustrates another embodiment for a branched braid member 400. Referring to FIG. 4, branched braid member 400 may be configured with eight tensile strands that branch out from a first braid portion 440. First braid portion 440 may generally comprise a plurality of tensile strands. In some embodiments, first end 442 of first braid portion 440 may be associated with first tensile strand 420, second tensile strand 422, third tensile strand 424 and fourth tensile strand 426. Likewise, second end 444 of first braid portion 440 may be associated with fifth tensile strand 450, sixth tensile strand 452, seventh tensile strand 454 and eighth tensile strand 456. In the embodiment shown in FIG. 4, each of first tensile strand 420, second tensile strand 422, third tensile strand 424, fourth tensile strand 426, fifth tensile strand 450, sixth tensile strand 452, seventh tensile strand 454 and eighth tensile strand 456 may branch further into plurality of threads 470.

Some embodiments may include provisions for tuning the tensile strength along one or more portions of a branched braid member. In some embodiments, a branched braid member can include multiple braid portions that comprise different numbers of tensile strands. For example, some embodiments include a first braid portion and a second braid portion that may branch off of the first braid portion. In some cases, the second braid portion may comprise fewer tensile strands than the first braid portion, thereby allowing the tensile strength of the second braid portion to be varied relative to the first braid portion.

Figure 5:
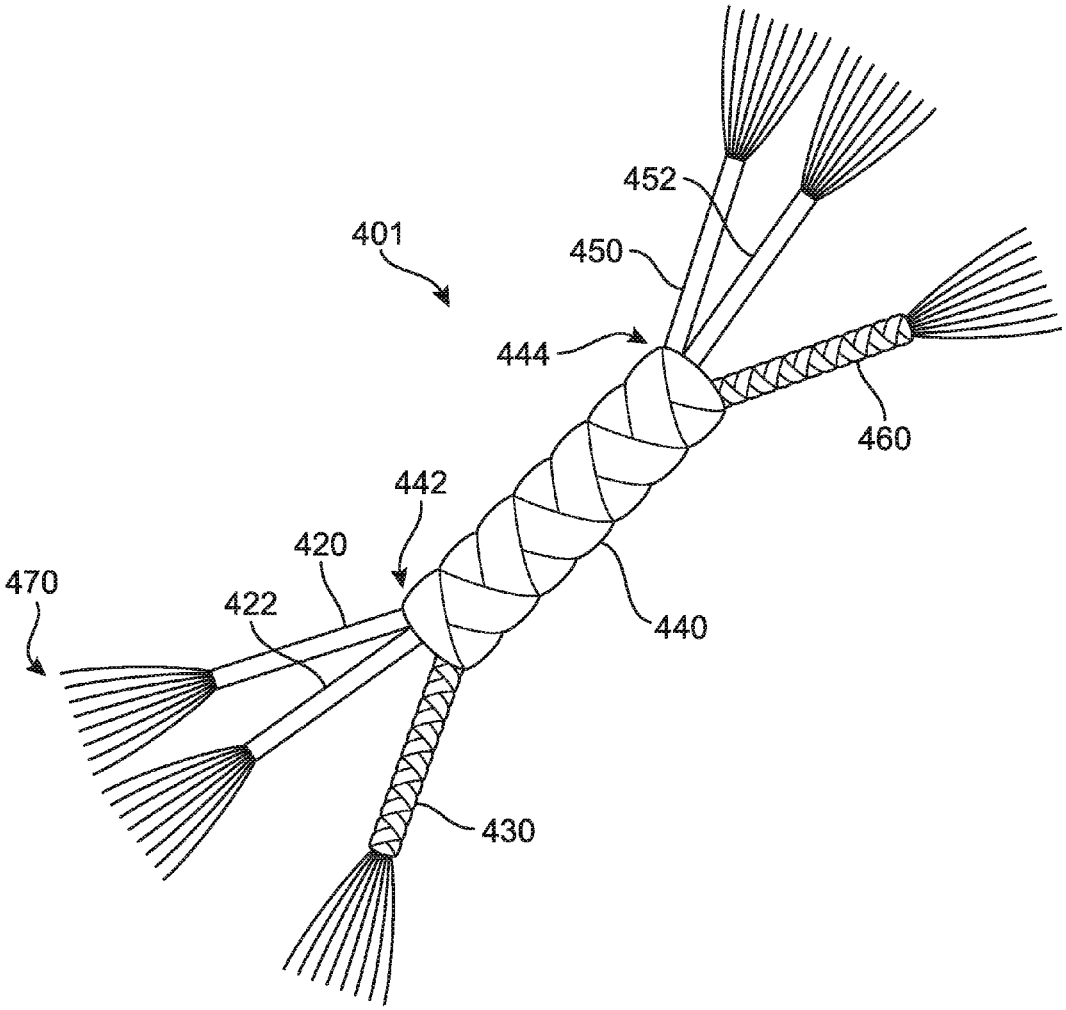
FIG. 5 is a schematic view of an embodiment of a braid portion that branches into a combination of tensile strands and further braid portions.

The configuration of a branched braid member 401, shown in FIG. 5, may be substantially similar to the configuration of branched braid member 400 shown in FIG. 4. For purposes of clarity, like numerals are used for like parts. However, in the configuration of FIG. 5, branched braid member 401 may include additional braided portions that branch off from first braid portion 440. In particular, branched braid member 401 includes a second braid portion 430 that branches from first end 442 of first braid portion 440 and a third braid portion 460 that branches from second end 444 of first braid portion 440. In this embodiment, second braid portion 430 and third braid portion 460 comprise smaller braids than first braid portion 440. This may be accomplished, in some cases, by forming second braid portion 430 and third braid portion 440 using a fewer number of tensile strands than the number used to form first braid portion 440. As one example, in some embodiments, second braid portion 430 and third braid portion 440 may each comprise two individual tensile strands that are braided together. For example, in some embodiments, second braid portion 430 may be formed by braiding third tensile strand 424 and fourth tensile strand 426 of branched braid member 400 shown in FIG. 4. Likewise, in some embodiments, third braid portion 460 may be formed by braiding seventh tensile strand 454 and eighth tensile strand 456 of branched braid member 400 (see FIG. 4). In other embodiments, however, second braid portion 430 and third braid portion 460 could be formed from any other number of tensile strands as well as directly from one or more threads.

In the embodiment shown in FIG. 5, each of first tensile strand 420, second tensile strand 422, fifth tensile strand 450 and sixth tensile strand 452 branches further into plurality of threads 470. Likewise, second braid portion 430 and third braid portion 460 may also each branch into individual threads of plurality of threads 470. In some cases, one or more threads from plurality of threads 470 may be integrated into a portion of an article of footwear and/or apparel.

Figure 6:
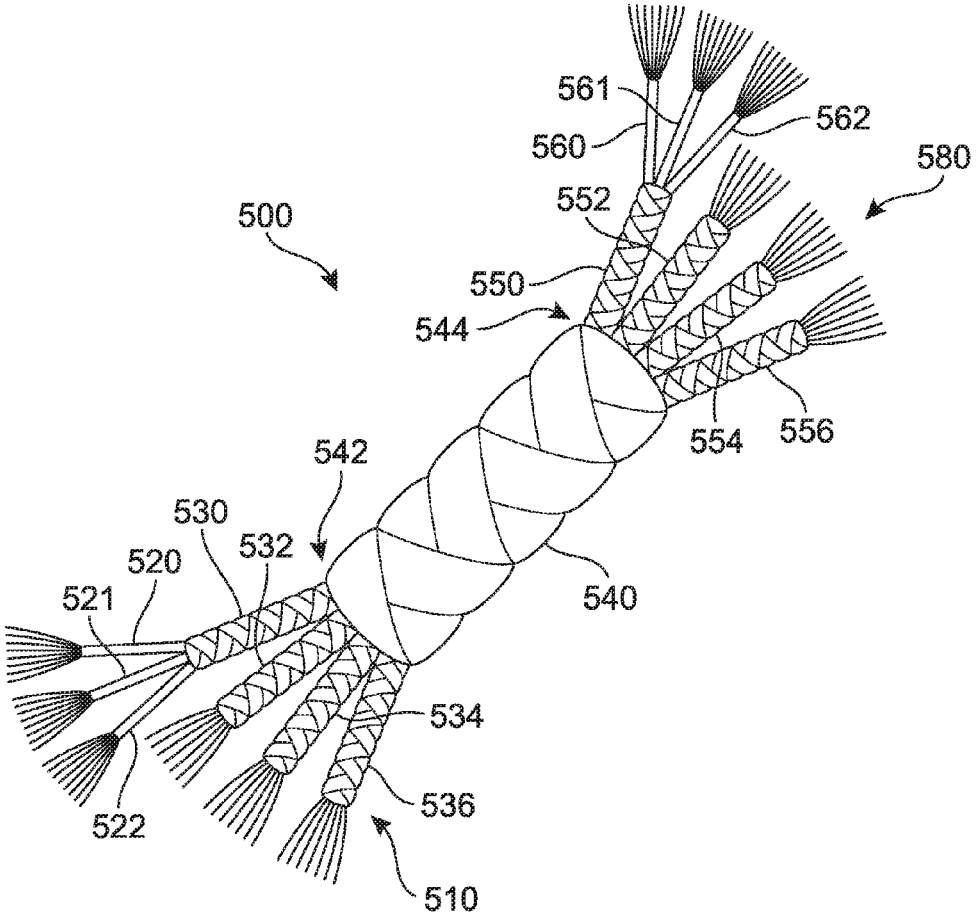
FIG. 6 is a schematic view of an embodiment of a braid portion that branches into multiple smaller braids on both ends where at least one of the smaller braids further branches into multiple tensile strands.
Figure 7:
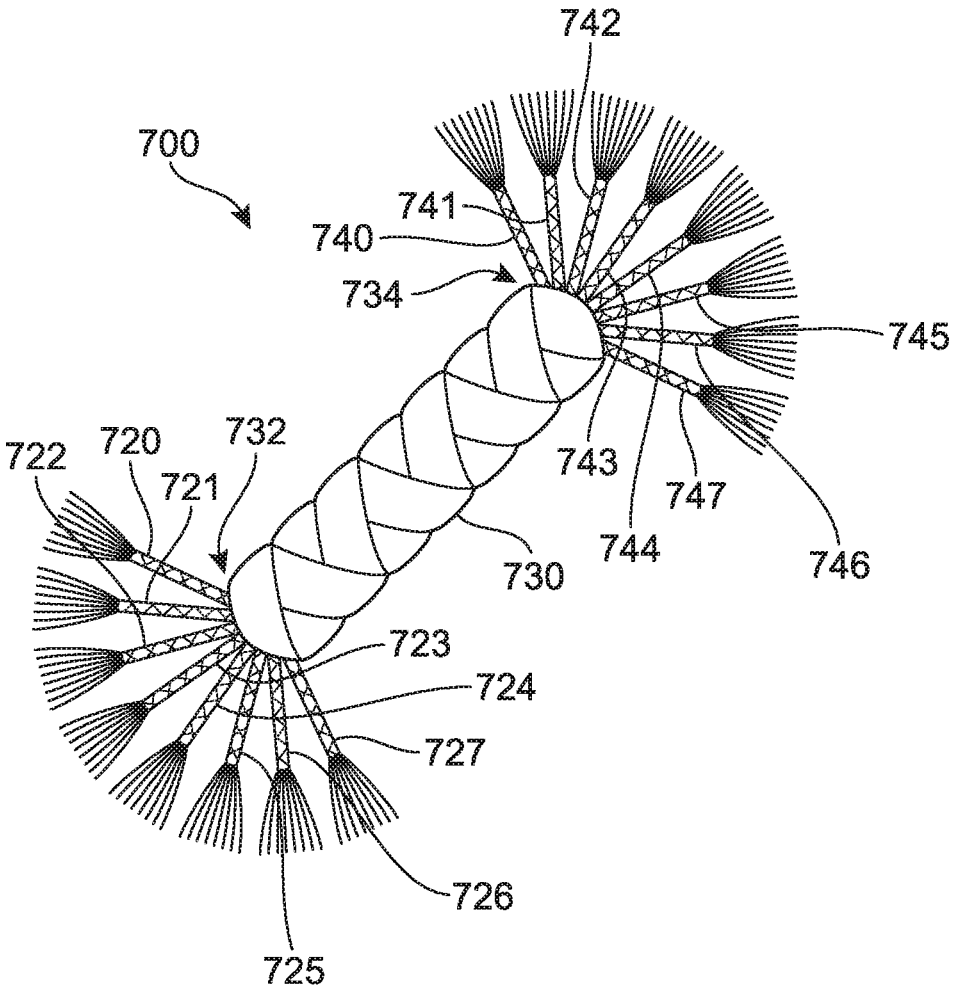
FIG. 7 is a schematic view of an embodiment of a braid that branches into multiple tensile strands on both ends.

In other embodiments, some braid portions may branch into individual tensile strands, rather than directly branching into individual threads. FIG. 6 illustrates one possible embodiment of a branched braid member 500 where some braid portions branch into further braid portions, while others branch into individual tensile strands. Referring to FIG. 6, a central braid portion 540 of branched braid member 500 may branch into a plurality of secondary braid portions 510. Plurality of secondary braid portions 510 includes first secondary braid portion 530, second secondary braid portion 532, third secondary braid portion 534, fourth secondary braid portion 536, fifth secondary braid portion 550, sixth secondary braid portion 552, seventh secondary braid portion 554 and eighth secondary braid portion 556. In this embodiment, each braid of plurality of secondary braid portions 510 may comprise at least two tensile strands.

As seen in FIG. 6, some braid portions may branch directly into plurality of threads 580. However, some braid portions, including first secondary braid portion 530 and fifth secondary braid portion 550, may further split into individual tensile strands. In particular, first secondary braid portion 530 may further branch into first tensile strand 520, second tensile strand 522 and third tensile strand 522. Also, fifth secondary braid portion 550 may further branch into fourth tensile strand 560, fifth tensile strand 561 and sixth tensile strand 562. Moreover, each of first tensile strand 520, second tensile strand 522, third tensile strand 524, fourth tensile strand 560, fifth tensile strand 561 and sixth tensile strand 562 may further branch into threads of plurality of threads 580.

Using this arrangement, the tensile strength along different portions of branched braid member 500 can be tuned, for example, by using braids of different sizes. Likewise, each braid portion can be branched further into additional braid portions, individual tensile strands and/or individual threads according to the desired tensile strength. Additionally, the type of structure used along different portions of a branched braid member may be selected to accommodate different methods of attaching branched braid member 500 to an article of footwear and/or apparel.

While FIG. 6 depicts a branched braid having a central braid portion that branches into four branches at both ends, the branched braid of the present disclosure may include more than four branches at either end of the central braid portion. As shown in the embodiments depicted in FIG. 7, each end of the central braid portion 730 of branched braid 700 may include eight tensile strands. First end 732 of central braid portion 730 may include first tensile strand 720, second tensile strand 721, third tensile strand 722, fourth tensile strand 723, fifth tensile strand 724, sixth tensile strand 725, seventh tensile strand 726, and eighth tensile strand 727. Similarly, second end 734 of central braid portion 730 may include another eight tensile strands, including ninth tensile strand 740, tenth tensile strand 741, eleventh tensile strand 742, twelfth tensile strand 743, thirteenth tensile strand 744, fourteenth tensile strand 745, fifteenth tensile strand 746 and sixteenth tensile strand 747. As stated above, a branched braid may include any number of branches at one or more ends of a central braid portion.

Figure 8:
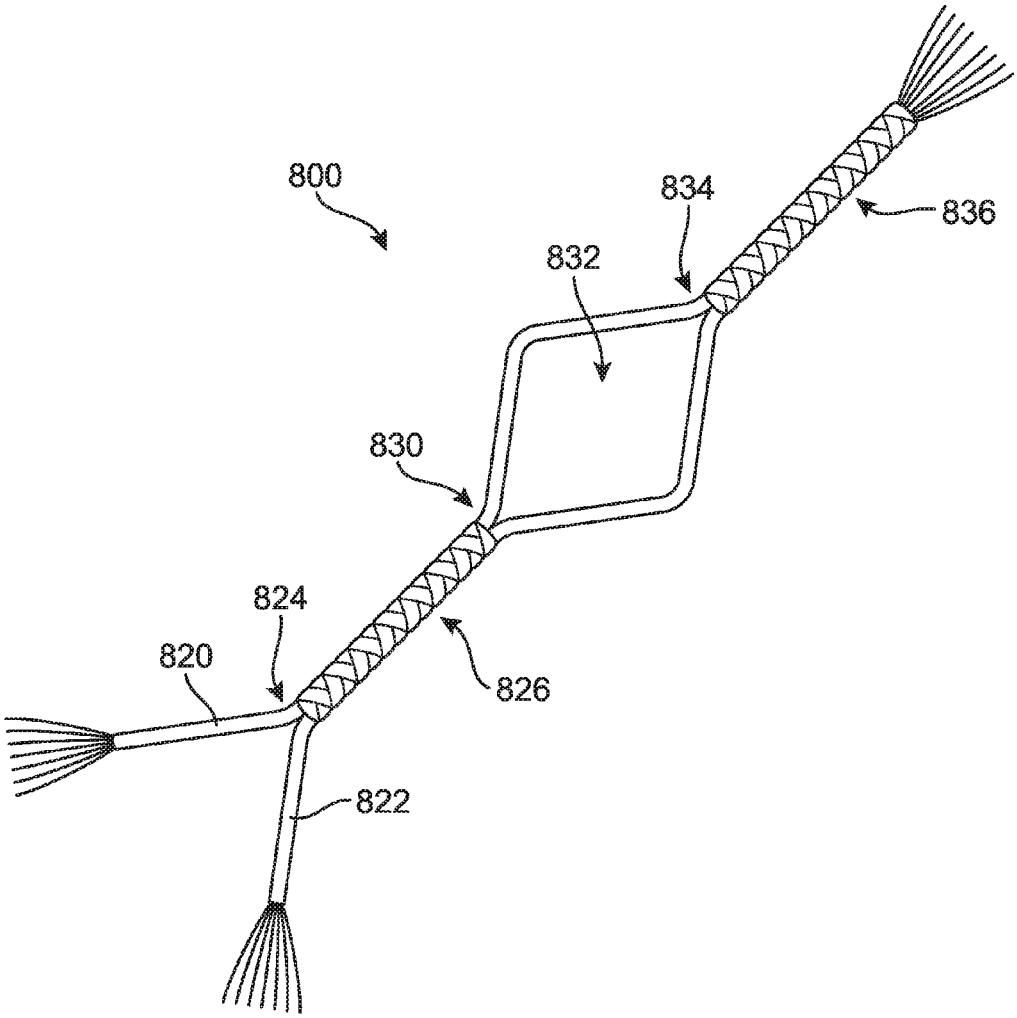
FIG. 8 is a schematic view of an embodiment of multiple individual tensile strands that are joined side by side and which may split apart into individual tensile strands and come together in multiple locations.

The embodiments described above and shown in FIGS. 1-7 illustrate embodiments that include a braided or twisted portion. In other embodiments, one or more tensile strands could be woven together without twisting or braiding. In some embodiments, for example, the tensile strands may be woven in a side-by-side manner. FIG. 8 depicts an embodiment in which tensile strands may be woven side by side to form a branched tensile member.

As shown in FIG. 8, branched tensile member 800 may include first tensile strand 820 and second tensile strand 822. First tensile strand 820 and second tensile strand 822 may be individual tensile strands that may be formed or joined together at certain portions. More specifically, first tensile strand 820 and second tensile strand 822 may be joined at first joined portion 826. First joined portion 826 may begin at first intersection 824 and continue to second intersection 830.

First tensile strand 820 and second tensile strand 822 may be joined at first joined portion 826 in any suitable manner. In some embodiments, first tensile strand 820 and second tensile strand 822 may be joined at first joined portion 826 by fusing the tensile strands together. In other embodiments, first tensile strand 820 and second tensile strand 822 may be joined at first joined portion 826 by weaving the tensile strands together. Such a configuration is shown in FIG. 8. In those embodiments where the tensile strands are woven together at joined portions, the strands may be joined by using a Jacquard weaving loom or machine.

Further, at second intersection 830, first joined portion 826 may separate into individual tensile strands. Individual first tensile strand 820 and second tensile strand 822 may separate in different directions to form void 832. Void 832 may be located between second intersection 830 and third intersection 834. At intersection 834, first tensile strand 820 and second tensile strand 822 may be joined again. Joining first tensile strand 820 and second tensile strand 822 again may form second joined portion 836 via weaving, for example.

The tensile strands may be joined any number of times to form any number of joined portions. The number of joined portions in a branched tensile member may depend on the purpose of the tensile member, the location of the branched tensile member on an article of footwear and/or apparel, and the desired support for a particular location on an article, among other factors.

The embodiment shown in FIG. 8 may also be incorporated into an upper of an article of footwear. The joined portions of the embodiment of FIG. 8 may be located on any portion of an upper in the same manner as the braid portions of those embodiments described above and shown in FIGS. 1-7.

As mentioned above, branched braid members (as well as other kinds of branched tensile members) may be incorporated into various kinds of articles, including both articles of footwear and articles of apparel. FIGS. 9 through 15 illustrate various embodiments of branched braid members that may be incorporated into an article of footwear. The figures show exemplary embodiments of articles of footwear, however it will be understood that the branched braid members (as well as other kinds of branched tensile members) could be incorporated into any other kinds of footwear as well as other kinds of apparel and/or sporting equipment. A branched braid member may be used with various kinds of articles including, but not limited to: hiking boots, soccer shoes, football shoes, sneakers, running shoes, cross-training shoes, rugby shoes, basketball shoes, baseball shoes as well as other kinds of shoes. Moreover, in some embodiments, a branched braid member may be configured for use with various kinds of non-sports related footwear, including, but not limited to: slippers, sandals, high heeled footwear, loafers as well as any other kinds of footwear, apparel and/or sporting equipment (e.g., gloves, helmets, etc.).

Figure 9:
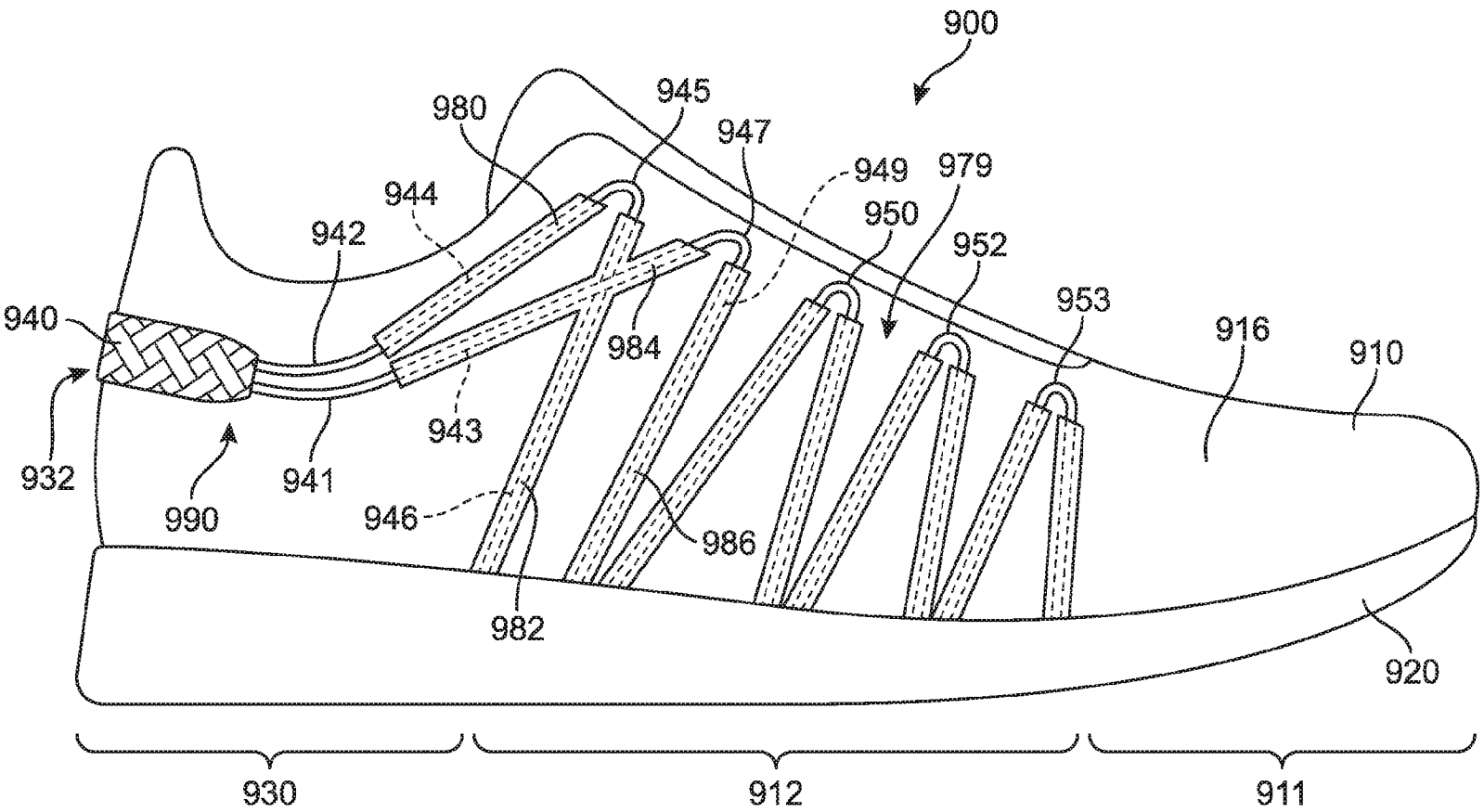
FIG. 9 is a schematic view of an embodiment of an article of footwear having an upper that includes a braid portion that branches into multiple tensile strands.
Figure 10:
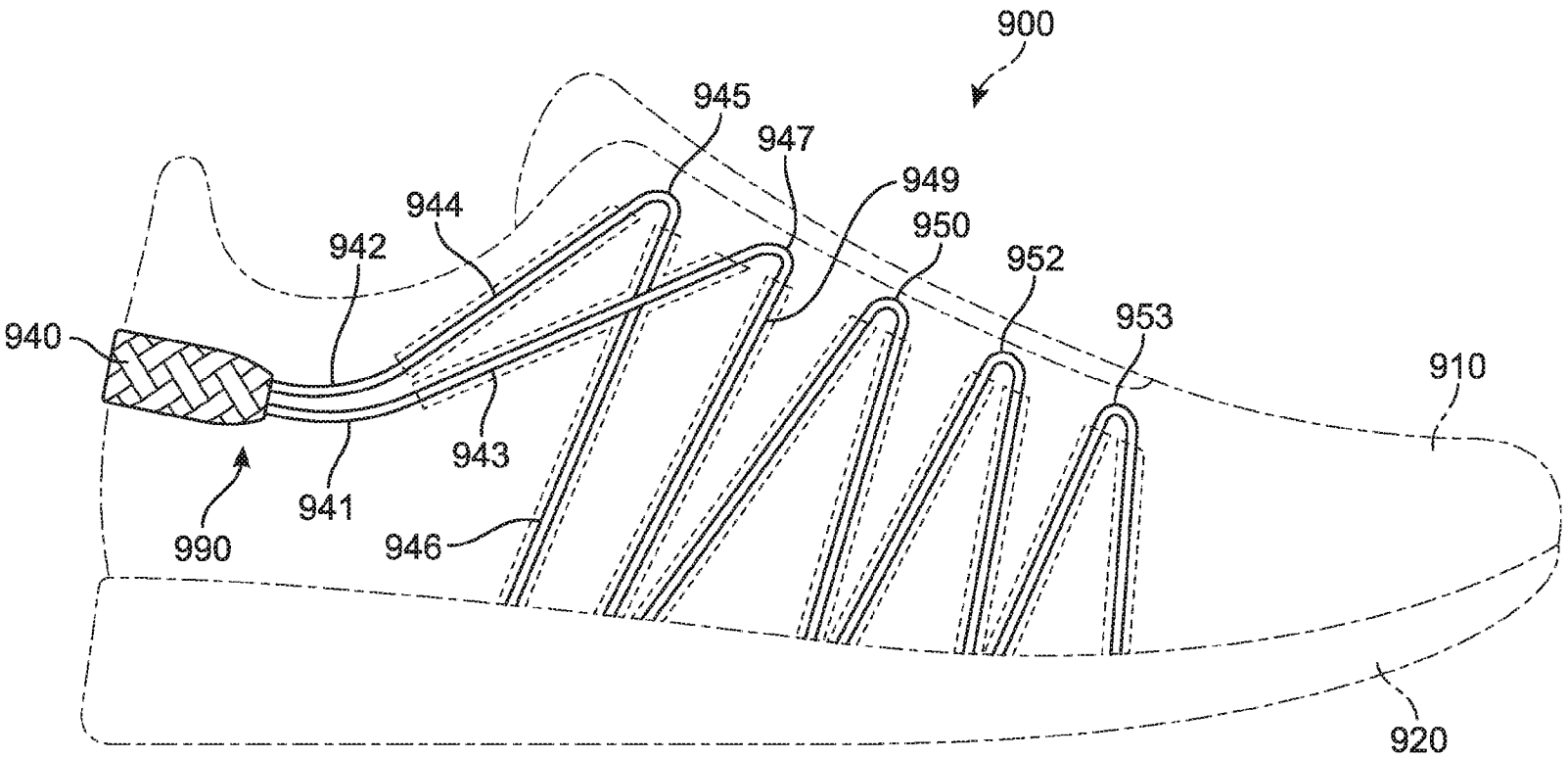
FIG. 10 is a schematic view of the article of footwear of FIG. 9, in which channels on the upper are shown in phantom.
Figure 11:
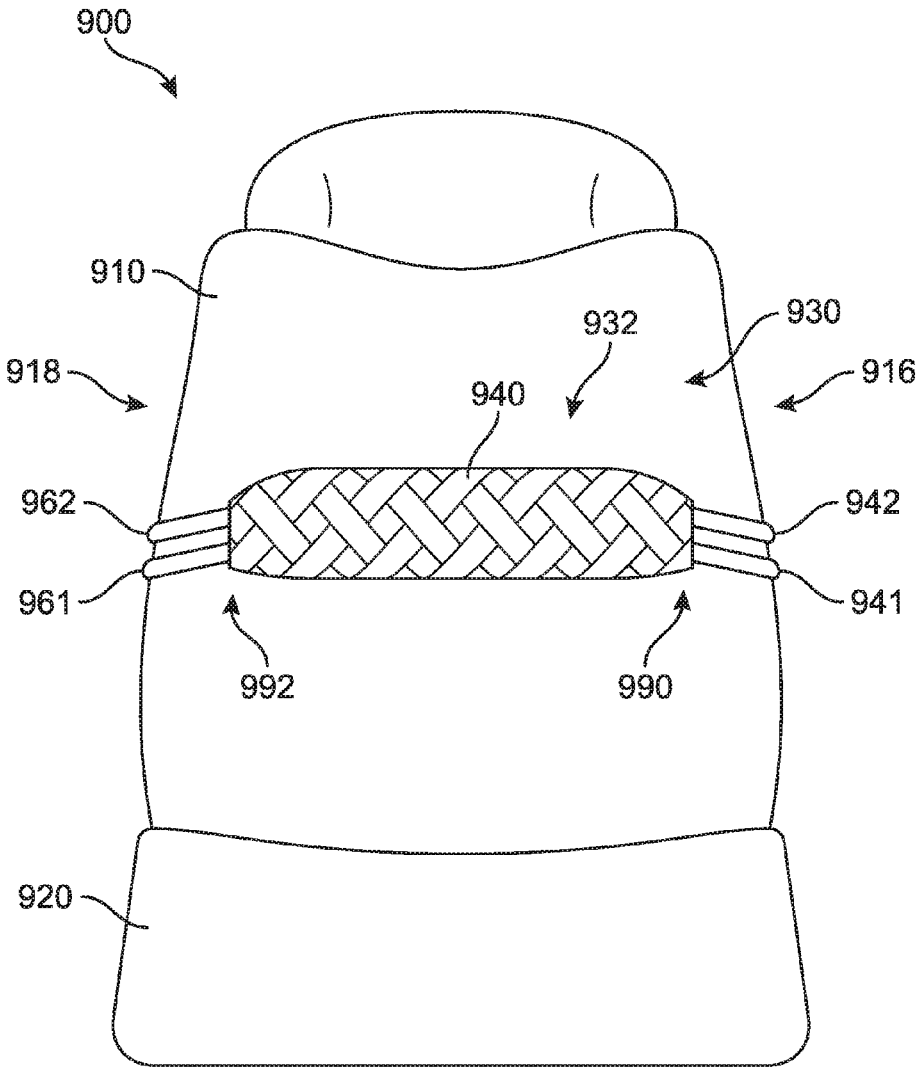
FIG. 11 is a rear view of the article of footwear depicted in FIG. 9.

FIGS. 9 through 11 illustrate schematic views of an embodiment of an article of footwear 900 that incorporates a branched braid member 932. In particular, FIGS. 9 and 10 show schematic side views of an embodiment of article 900 with branched braid member 932, while FIG. 11 shows a schematic rear view of article 900 with branched braid member 932. Referring to FIGS. 9 through 11, article of footwear 900 may include a sole structure 920 and an upper 910. For purposes of convenience, article of footwear 900 is also simply referred to as article 900.

Generally, upper 910 may be any type of upper. In particular, upper 910 may have any design, shape, size and/or color. For example, in embodiments where article 900 is a basketball shoe, upper 910 could be a high top upper that is shaped to provide high support on an ankle. In embodiments where article 900 is a running shoe, upper 910 could be a low top upper. In still other embodiments, upper 910 could have any other shape and/or design and may further include any provisions and/or features such as laces, straps, heel counters, a tongue as well as other provisions used with uppers.

In some embodiments, sole structure 920 may be configured to provide traction for article 900. In addition to providing traction, sole structure 920 may attenuate ground reaction forces when compressed between the foot and the ground during walking, running or other ambulatory activities. The configuration of sole structure 920 may vary significantly in different embodiments to include a variety of conventional or non-conventional structures. In some cases, the configuration of sole structure 920 can be configured according to one or more types of ground surfaces on which sole structure 920 may be used. Examples of ground surfaces include, but are not limited to: natural turf, synthetic turf, dirt, as well as other surfaces.

Sole structure 920 is secured to upper 910 and extends between the foot and the ground when article 900 is worn. In different embodiments, sole structure 920 may include different components. For example, sole structure 920 may include an outsole, a midsole, and/or an insole. In some cases, one or more of these components may be optional.

Referring to FIG. 9, for purposes of reference, article 900 may be divided into forefoot portion 911, midfoot portion 912 and heel portion 930. Forefoot portion 911 may be generally associated with the toes and joints connecting the metatarsals with the phalanges. Midfoot portion 912 may be generally associated with the arch of a foot. Likewise, heel portion 930 may be generally associated with the heel of a foot, including the calcaneus bone. In addition, article 911 may include lateral side 916 and medial side 918 (see FIG. 11). In particular, lateral side 916 and medial side 918 may be opposing sides of article 900.

It will be understood that forefoot portion 911, midfoot portion 912 and heel portion 930 are only intended for purposes of description and are not intended to demarcate precise regions of article 900. Likewise, lateral side 916 and medial side 918 are intended to represent generally two sides of an article, rather than precisely demarcating article 900 into two halves. In addition, forefoot portion 911, midfoot portion 912 and heel portion 930, as well as lateral side 916 and medial side 918, can also be used in describing individual components of an article, such as a sole structure and/or an upper.

Referring again to FIGS. 9 through 11, in some embodiments, branched braid member 932 may comprise a central braid portion 940. Additionally, a first tensile strand 941 and a second tensile strand 942 may branch off from a first end 990 of central braid portion 940. Also, a third tensile strand 961 and a fourth tensile strand 962 may branch off from a second end 992 of central braid portion 940.

Generally, a branched braid member can be incorporated into any portion of an article. In some embodiments, a branched braid member can be incorporated into an upper. In other embodiments, a branched braid member can be incorporated into a sole structure. In still other embodiments, a branched braid member may be incorporated into portions of an upper as well as portions of a sole structure. In an exemplary embodiment, branched braid member 932 may generally be incorporated into portions of upper 910, with some portions of one or more tensile strands extending to sole structure 920.

In some embodiments, central braid portion 940 may be positioned around heel region 930 of upper 910 of article 900. First tensile strand 941 and second tensile strand 942 may be further positioned on lateral side 916 of upper 910. Further, corresponding tensile strand 961 and tensile strand 962 (see FIG. 11) may be positioned on medial side 918 of upper 910.

In other embodiments, the central braid portion may be positioned in a location other than the heel region. For instance, the central braid portion of a branched braid member may be positioned on the instep portion of an upper. In further embodiments, the central braid portion of a branched braid member may be positioned on the toe portion of an upper. The tensile strands of the branched braid member positioned on the midfoot region or forefoot region of an upper may be positioned on the medial and/or lateral sides of the upper.

In some embodiments, upper 910 may include one or more channels for receiving tensile strands. In one embodiment, upper 910 may include plurality of channels 979, which may include first channel 980, second channel 982, third channel 984, and fourth channel 986 as well as other channels.

The channels in upper 910 may be formed by any suitable method. In some embodiments, the channels may be voids between the parts of upper 910, as depicted in the embodiments shown in FIGS. 13-15, which are discussed in detail below. In other embodiments, the channels may be formed through a high frequency welding method, such as ultrasonic welding, in which portions of two layers of material are joined along welds, thereby forming channels between the welds. Still other welding methods are possible and could include, for example, radio-frequency welding methods. In some embodiments, radio frequency welding could be used in conjunction with a hot melt adhesive to create channels. In some embodiments, thermoplastic polyurethane (TPU) could be incorporated into an article of footwear, for example as an outer layer, which may then be welding using any kinds of welding methods. Moreover, the embodiments are not limited to channels formed by welding, and in other embodiments channels could be formed using any other methods such as, but not limited to: stitching, gluing, stapling, as well as other methods known in the art for joining materials, including opposing layers of a spacer textile material.

An exemplary ultrasonic welding method is disclosed in Beye et al., U.S. Pat. No. 9,132,601, now U.S. Patent Application Publication Number 2014/0196314, published Jul. 17, 2014, and titled "Spacer Textile Material with Tensile Strands Having Multiple Entry and Exit Points," (previously U.S. patent application Ser. No. 13/741,428 filed Jan. 15, 2013), the entirety of which is hereby incorporated by reference.

Central braid portion 940 may be incorporated into upper 910 by any suitable means. In some embodiments, central braid portion 940 is attached to upper 910 by a loop (not shown) that is attached to upper 910. In other embodiments, central braid portion 940 is attached to upper 910 through stitching. In further embodiments, central braid portion 940 may not be attached to upper 910. In other words, central braid portion 940 may move freely about upper 910.

As stated above, central braid portion 940 may branch into two or more tensile strands. In particular, first tensile strand 941 and second tensile strand 942 as well as third tensile strand 961 and fourth tensile strand 962 may branch from central braid portion 940. Each tensile strand may be further incorporated into upper 910. Each tensile strand may be disposed externally or internally on or in upper 910.

In some embodiments, some portions of first tensile strand 941 may be disposed within one or more channels on upper 910. In some embodiments, first portion 943 of first tensile strand 941 may be disposed in third channel 984, a third portion 949 of first tensile strand 941 may be disposed in fourth channel 986, and a second portion 947 of first tensile strand 941 may extend outwardly on upper 910 between third channel 984 and fourth channel 986.

In some embodiments, some portions of second tensile strand 942 may be disposed within one or more channels on upper 910. In some embodiments, first portion 944 of second tensile strand 942 may be disposed in first channel 980, a third portion 946 of second tensile strand 942 may be disposed in second channel 982, and a second portion 945 of second tensile strand 942 may extend outwardly on upper 910 between first channel 980 and second channel 982.

In some embodiments, second portion 947 of first tensile strand 941 and second portion 945 of second tensile strand 942 may form loops on upper 910 that may be configured to receive a fastener, such as a lace. Likewise, portions of the remaining tensile strands in plurality of tensile strands 979 may form third loop 950, fourth loop 952 and fifth loop 953. Third loop 950, fourth loop 952 and fifth loop 953 may also be used to accept laces for article 900.

While the end of each tensile strand disposed adjacent to sole structure 920 are not shown, the ends of each tensile strand may be finished in any suitable manner. In some embodiments, each tensile strand may be finished with upper 910, for example, along a lower portion or edge of upper 910. In some embodiments, upper 910 and the ends of plurality of tensile strands 979 may be finished in a strobel last. In other embodiments, upper 910 and the ends of each tensile strand may be finished in a slip or center-stitched last. In further embodiments, upper 910 and the ends of each tensile strand may be finished by bonding the ends of each tensile strand to a lasting board. In still further embodiments, upper 910 and/or each tensile strand may be incorporated into sole structure 920.

Figure 12:
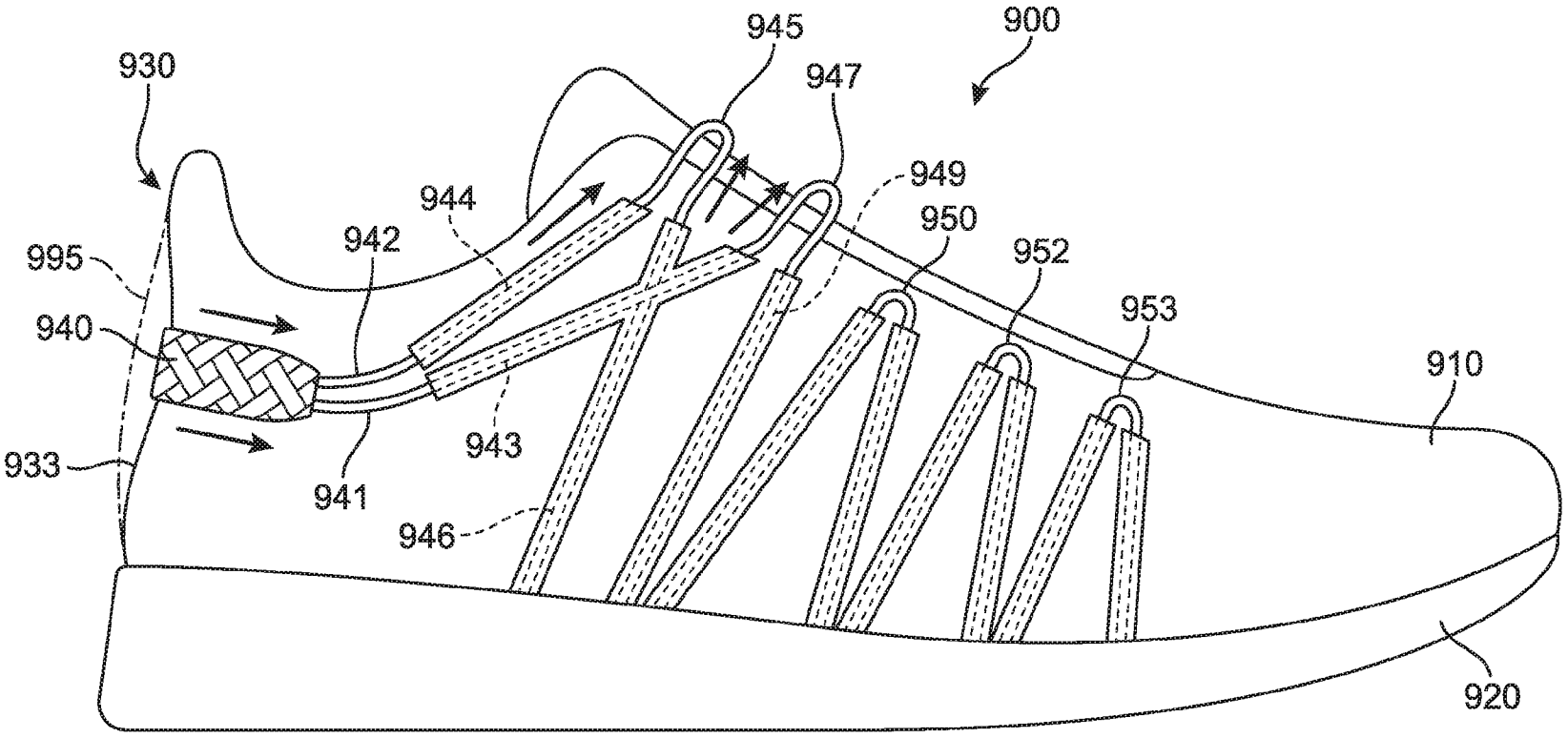
FIG. 12 is a schematic view of the article of FIG. 9, where tension has been applied to the multiple tensile strands.

FIG. 12 illustrates a schematic view of article 900 in a state where tension has been applied to first tensile strand 941 and second tensile strand 942 (for example, by a lace). Though not shown, it will be understood that this state is associated with a similar amount of tension being applied to third tensile strand 961 and fourth tensile strand 962. Using this configuration for branched braid member 932, tension applied to second portion 947 of first tensile strand 941 and second portion 945 of second tensile strand 942 may tend to apply tension to braid portion 940. In particular, as seen in FIG. 12, this tension may generally cause braid portion 940 to depress rearward end 993 of upper 910 inwardly from a default position 995. Thus, as a user tensions first tensile strand 941 and second tensile strand 942 (as well as third tensile strand 961 and fourth tensile strand 962) with a lace or other means, heel portion 930 of upper 910 may be tightened against the heel of the foot to better secure article 900 to the foot.

As stated above, portions of a branched braid may be incorporated into channels in an upper. In some embodiments, the channels may be voids or spaces formed by the various components of the upper. For instance, a shoe upper may be formed from spacer textile material. A spacer textile material may include a first layer, a second layer that is at least partially coextensive with first layer. In addition, a spacer textile material may have a plurality of connecting members that extend between and join first layer and second layer.

Examples of spacer textile material and methods of making spacer textile material are disclosed in any of the following: Chao et al., U.S. Patent Publication Number 2013/0266773, published Oct. 10, 2013, and entitled, "Spacer Textile Materials and Methods for Manufacturing the Spacer Textile Materials"; Goodwin et al., U.S. Pat. No. 6,119,371, issued on Sep. 19, 2000 and entitled "Resilient Bladder for Use in Footwear"; and Goodwin, U.S. Pat. No. 7,076,891, issued on Jul. 18, 2006, and entitled "Flexible Fluid-Filled Bladder for an Article of Footwear," the entirety of each being incorporated by reference.

Figure 13:
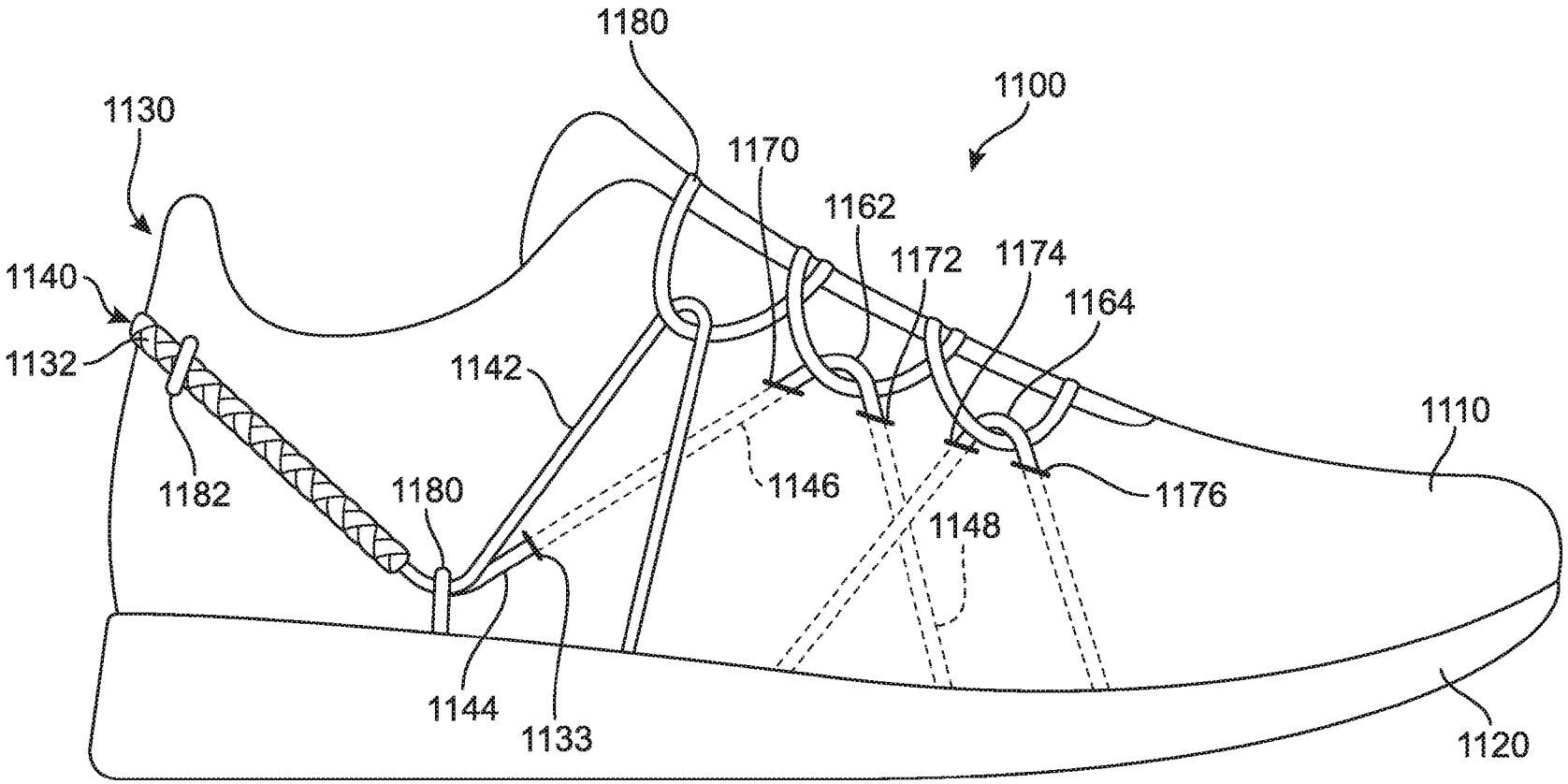
FIG. 13 is a schematic view of an embodiment of an article of footwear having an upper that includes a braid that branches into multiple tensile strands.
Figure 14:
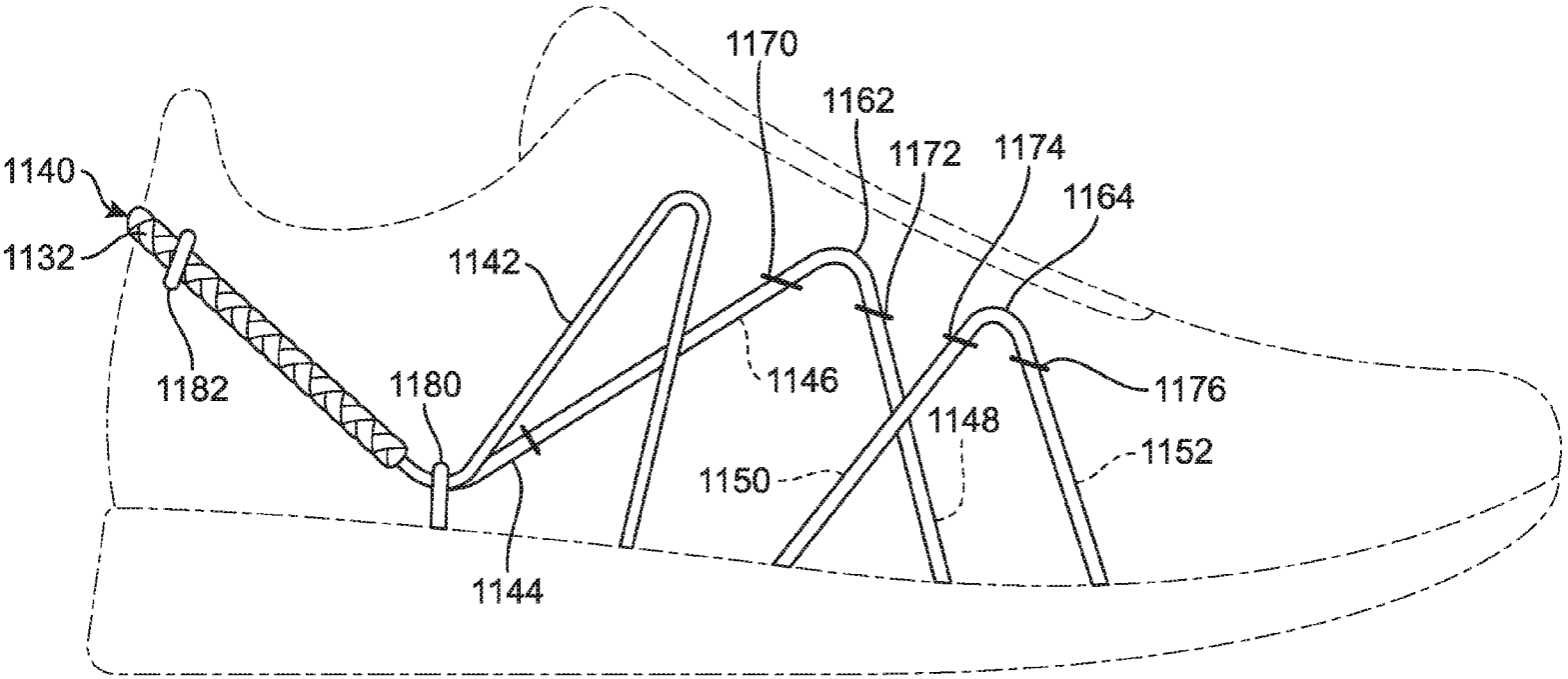
FIG. 14 is a schematic view of the article of footwear of FIG. 13, where the upper and sole structure are shown in phantom.
Figure 15:
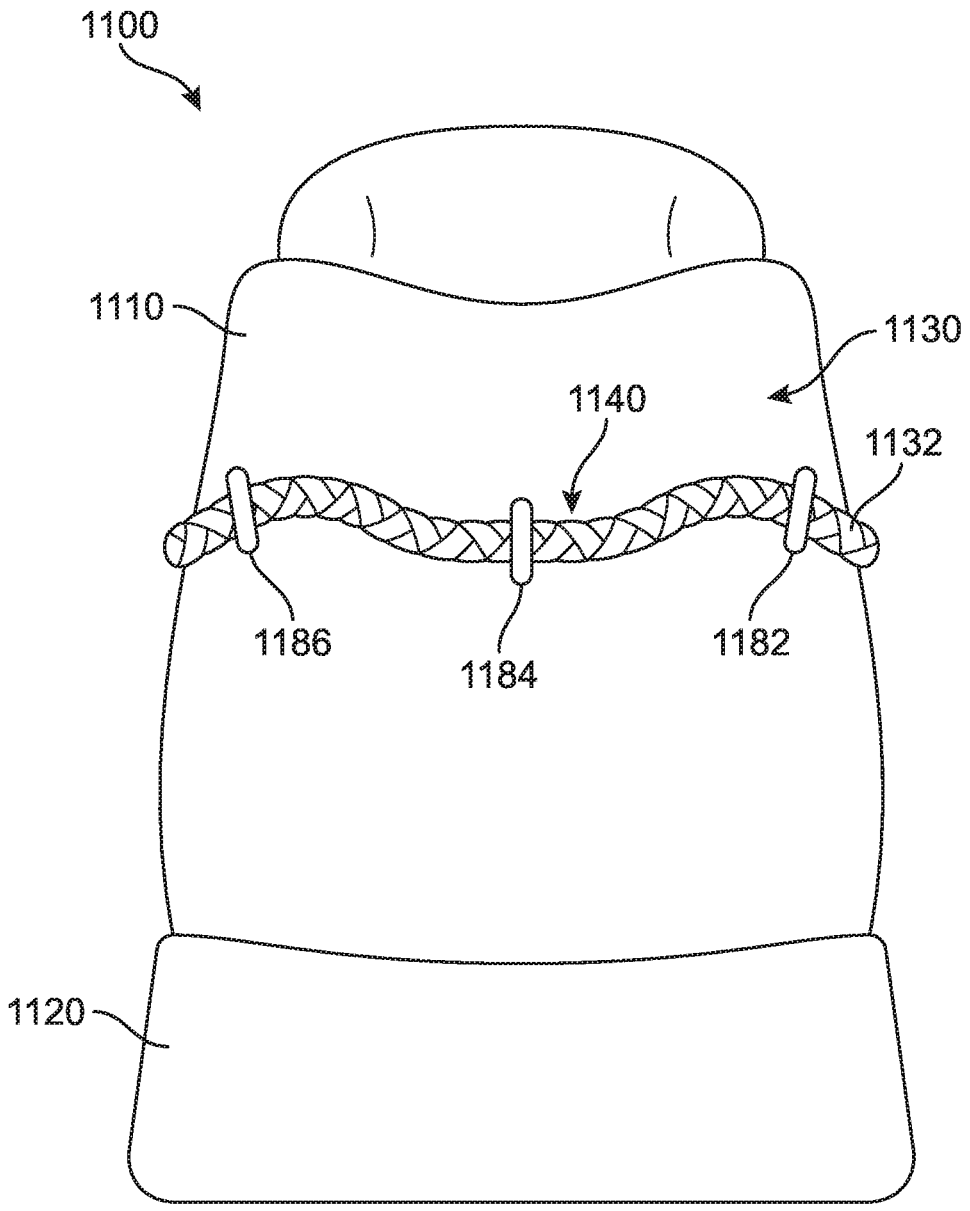
FIG. 15 is a rear view of the article of footwear depicted in FIG. 13.

FIGS. 13 through 15 illustrate still another possible configuration for a branched braid member 1140 on an article of footwear 1100. Referring first to FIG. 13, the embodiment of article 1100 depicted in FIG. 13 may include upper 1110. In some embodiments, upper 1110 may be formed from spacer textile material. Upper 1110 may further include channels, or voids between the components of the spacer textile material. In addition, article 1100 may include sole structure 1120.

In addition to the above components, article 1100 may include branched braid member 1140. Branched braid member 1140 may include central braid portion 1132, first tensile strand 1142 and second tensile strand 1144 as well as possibly other tensile strands. Branched braid 1140 may be incorporated into upper 1110 of article 1100. Central braid portion 1132 may be disposed from the medial side of upper 1110, around heel region 1130, to the lateral side of upper 1110.

Central braid portion 1132 may be incorporated into upper 1110 by any suitable means. In some embodiments, central braid portion 1140 may attached to article 1100 by one or more loops, including first loop 1180, second loop 1182, third loop 1184 and fourth loop 1186, as well as possibly other loops on a medial side of upper 1110. In other embodiments, central braid portion 1140 may be attached to upper 1110 through stitching. In further embodiments, central braid portion 1140 may not be attached to upper 1110. In other words, central braid portion 1140 may move freely about upper 1110.

As stated above, central braid portion 1140 may branch into two or more tensile strands. In some embodiments, first tensile strand 1142 and second tensile strand 1144 may branch from central braid portion 1132. Each tensile strand may be further incorporated into upper 1110.

In some embodiments, first tensile strand 1142 branches from central braid portion 1132. In some cases, first tensile strand 1142 may extend from central braid portion 1132 through first loop 1180, up to lace 1180 and then back down to sole structure 1120. In particular, in some embodiments, a majority of first tensile strand 1142 may remain external to upper 1110.

In some embodiments, second tensile strand 1144 may extend from central braid portion 1132 through first loop 1180 and into a first opening 1133 on the outer surface of upper 1110. From first opening 1133, a portion 1146 of second tensile strand 1144 may extend within upper 1110 to second opening 1170 at which point second tensile strand 1144 may exit upper 1110. At second opening 1170, a portion 1162 of second tensile member 1144 may loop through lace 1180 and back into third opening 1172. A portion 1148 of second tensile strand 1144 may extend within upper 1110 from third opening 1172 to sole structure 1120.

In some embodiments, a third tensile strand 1164, which is not connected to central braid portion 1132, may extend within upper 1110. In particular, third tensile strand 1164 may pass from sole structure 1120, through a fifth opening 1174, and loop back around into upper 1110 through sixth opening 1176. In some cases, third tensile strand 1164 may also form a loop that engages with lace 1180.

With this arrangement, as a user tensions first tensile strand 1142 and second tensile strand 1144, central braid portion 1132 may be pulled taut against heel portion 1130 of upper 1110, thereby pulling upper 1110 tighter against the foot at the heel. Moreover, the direction and magnitude of the tension applied to central braid portion 1132 can be varied according using various loops (e.g., first loop 1180, second loop 1182, third loop 1184 and fourth loop 1186) to control the positions and orientations of central braid portion 1132 as well as portions of first tensile strand 1142 and second tensile strand 1144.

Generally, these principles could be applied to any article that may be worn. In some embodiments, the article may include one or more articulated portions that are configured to move. In other cases, the article may be configured to conform to portions of a wearer in a three-dimensional manner. Examples of articles that are configured to be worn include, but are not limited to: footwear, gloves, shirts, pants, socks, scarves, hats, jackets, as well as other articles. Other examples of articles include, but are not limited to: protective equipment such as shin guards, knee pads, elbow pads, shoulder pads, as well as any other type of protective equipment. Additionally, in some embodiments, the article could be another type of article including, but not limited to: bags, purses, backpacks, as well as other articles that may or may not be worn. Still further, the article could be an article of sporting equipment such as bats, balls (e.g., golf balls, basketballs, baseballs, footballs, tennis balls and other kinds of balls), pucks, hockey sticks, racquets, golf clubs, as well as other kinds of sporting equipment.

It will be further understood that the branched tensile members discussed above, and shown for example in FIG. 8, may likewise be incorporated into articles of footwear and/or apparel. Such branched tensile members could be arranged in any manner on the upper of an article of footwear, for example.

While various embodiments have been described, the description is intended to be exemplary, rather than limiting and it will be apparent to those of ordinary skill in the art that many more embodiments and implementations are possible. Accordingly, the embodiments are not to be restricted except in light of the attached claims and their equivalents. Also, various modifications and changes may be made within the scope of the attached claims.

What is claimed is:

1. An article of footwear comprising:

an upper and a sole structure; and a group of tensile strands forming a branched braid member, the branched braid member comprising a central braid portion, a first tensile strand, and a second tensile strand, wherein the central braid portion includes a first end and a second end, the central braid portion extends around a heel region of the article, the first tensile strand extends from the first end along an outer surface of the upper and the second tensile strand extends from the first end along an outer surface of the upper, and the second tensile strand extends along the outer surface of the upper towards a forefoot portion of the article and has at least one unexposed portion along that extends along an inner surface of the upper.

2. The article of claim 1, wherein the outer surface of the upper comprises a first opening and a second opening, and the at least one unexposed portion extends from the location of the first opening to the location of the second opening.

3. The article of claim 2, further comprising a passageway within the upper extends that extends between the first and second openings.

4. The article of claim 2, further comprising a third opening in the outer surface of the upper, wherein the second tensile strand comprises a first exposed portion that forms a loop between the second and third openings.

5. The article of claim 4, further comprising a third tensile strand that extends at least partly along the inner surface of the upper and that has at least a portion that is permanently secured to the sole structure, the third tensile strand having a second exposed portion that forms a second loop.

6. The article of claim 4, wherein the first tensile strand extends along the outer surface of the upper and forms a third loop.

7. The article of footwear of claim 6, wherein at least a portion of the first tensile strand is permanently secured to the sole structure and at least a portion of the second tensile strand is permanently secured to the sole structure.

8. The article of claim 1, wherein the central braid portion extends through a first securing loop in the heel region, and the first and second tensile strands extend through a second securing loop located proximate the sole structure.

9. The article of claim 1, wherein the branched braided member is incorporated into the upper.

10. An article of footwear comprising:

an upper and a sole structure; and a plurality of tensile strands forming a braid member having a first end and a second end, the plurality of tensile strands including a first tensile strand and a second tensile strand extending from the first end, and a third tensile strand and a fourth tensile strand extending from the second end, wherein the first and third tensile strands extend along an outer surface of the upper and are permanently secured to the sole structure, the first and third tensile strands forming a first and third exposed loop, respectively, and the second and fourth tensile strands extend at least partly beneath the outer surface of the upper and are permanently secured to the sole structure, the second and fourth tensile strands forming a second and fourth exposed loop, respectively.

11. The article of claim 10, wherein the outer surface of the upper comprises:

a first opening into which the second tensile strand enters and a second opening from which second tensile strand exits; and a third opening into which the fourth tensile strand enters and a fourth opening from which fourth tensile strand exits, wherein the second tensile strand extends at least partly beneath the outer surface of the upper between the first and second openings, and the fourth tensile strand extends at least partly beneath the outer surface of the upper between the third and fourth openings.

12. The article of claim 11, wherein the braid member extends through a first securing loop located in the heel region of the article, and the first and second tensile strands extend through a second securing loop located proximate the sole structure of the article on a medial side of the article.

13. The article of claim 12, wherein the third and fourth tensile strands extend through a third securing loop located proximate the sole structure of the article on a lateral side of the article.

14. The article of claim 11, wherein the braid member is incorporated into the upper.

15. An article of footwear comprising:

an upper and a sole structure; and a group of tensile strands forming a braid member, wherein the braid member comprising a central braid portion, a first tensile strand, and a second tensile strand, the central braid portion located at a heel region of the article and including a first end and a second end, the first tensile strand extends from the first end and is an exposed strand that extends along an outer surface of the upper, the second tensile strand extends from the first end and is a partly exposed strand that includes a first unexposed portion that extends along an inner surface of the upper, the first tensile strand forming a first loop along a first side of the upper, the second tensile strand having a first exposed portion that forms a second loop along the first side of the upper.

16. The article of claim 15, wherein the first tensile strand crosses over the first unexposed portion of the second tensile strand.

17. The article of claim 15, wherein at least a portion of the first tensile strand is permanently secured to the sole structure and at least a portion of the second tensile strand is permanently secured to the sole structure.

18. The article of claim 15, further comprising a third tensile strand with at least a portion that is permanently secured to the sole structure, the third tensile strand having a second exposed portion that forms a third loop and a second unexposed portion that extends along the inner surface of the upper and intersects with a third unexposed portion of the second tensile strand.

19. The article of claim 15, wherein the first tensile strand and the third tensile strand are a continuous piece.

* * * * *